US007254360B2

(12) United States Patent
Tomita

(10) Patent No.: US 7,254,360 B2
(45) Date of Patent: Aug. 7, 2007

(54) IMAGE FIXING APPARATUS, AND, IMAGE FORMING APPARATUS HAVING THE SAME, AND IMAGE FORMING PROCESS

(75) Inventor: Kunihiko Tomita, Hadano (JP)

(73) Assignee: Ricoh Company, Ltd., Tokyo (JP)

( * ) Notice: Subject to any disclaimer, the term of this patent is extended or adjusted under 35 U.S.C. 154(b) by 315 days.

(21) Appl. No.: 11/105,427

(22) Filed: Apr. 14, 2005

(65) Prior Publication Data

US 2005/0232664 A1 Oct. 20, 2005

(30) Foreign Application Priority Data

Apr. 15, 2004 (JP) ..... 2004-120100

(51) Int. Cl.
*G03G 15/20* (2006.01)

(52) U.S. Cl. ..... 399/329; 399/122

(58) Field of Classification Search ..... 399/107, 399/122, 320, 328, 329; 219/216
See application file for complete search history.

(56) References Cited

U.S. PATENT DOCUMENTS

| | | | | |
|---|---|---|---|---|
| 5,527,657 | A | 6/1996 | Takeda et al. | |
| 6,370,350 | B2 | 4/2002 | Tomita | |
| 6,370,352 | B1 | 4/2002 | Tomita | |
| 6,413,690 | B2 | 7/2002 | Tomita | |
| 6,455,217 | B2 | 9/2002 | Tomita | |
| 6,492,084 | B2 | 12/2002 | Tomita | |
| 6,505,016 | B2 | 1/2003 | Tomita | |
| 6,519,439 | B2 | 2/2003 | Tomita | |
| 6,623,897 | B2 | 9/2003 | Tomita | |
| 6,653,039 | B2 | 11/2003 | Tomita | |
| 6,771,926 | B2 * | 8/2004 | Ishikawa et al. | 399/329 |
| 6,778,788 | B2 | 8/2004 | Tomita et al. | |
| 2003/0039911 | A1 | 2/2003 | Tomita et al. | |
| 2003/0059224 | A1 | 3/2003 | Tomita | |
| 2003/0224277 | A1 | 12/2003 | Tomita | |

(Continued)

FOREIGN PATENT DOCUMENTS

| | | |
|---|---|---|
| JP | 63-313182 | 12/1988 |

(Continued)

*Primary Examiner*—Hoan Tran
(74) *Attorney, Agent, or Firm*—Oblon, Spivak, McClelland, Maier & Neustadt, P.C.

(57) ABSTRACT

The object of the present invention is to provide an image fixing apparatus which enables achieving saving of energy in fixing by controlling the temperature of a heater to fix a toner image on a recording medium, an image forming apparatus having the image fixing apparatus therein, and an image forming process using the same. To achieve the object, there is provided an image fixing apparatus which includes a heater having a heat source to generate heat; a fixing belt which moves in a direction to which a recording medium is transported in a state where the belt comes into contact with the heater; and a pressing portion which presses the transported recording medium with a toner image carried thereon on an area of the fixing belt which comes into contact with the heater, and is characterized in that the contact surface of the heater which comes into contact with the fixing belt has a smoothly formed convex toward the side which comes into contact with the fixing belt with a curvature radius of 200 mm to 100,000 mm, and an amount of contact time between the fixing belt and the recording medium is 20 msec. or more.

13 Claims, 4 Drawing Sheets

U.S. PATENT DOCUMENTS

| | | | | |
|---|---|---|---|---|
| 2003/0235442 | A1 | 12/2003 | Suzuki et al. | |
| 2004/0033431 | A1 | 2/2004 | Tomita | |
| 2004/0101332 | A1 | 5/2004 | Sohmiya | |
| 2004/0131398 | A1 | 7/2004 | Omata et al. | |
| 2007/0048045 | A1* | 3/2007 | Yagi et al. | 399/329 |

FOREIGN PATENT DOCUMENTS

| | | |
|---|---|---|
| JP | 1-263679 | 10/1989 |
| JP | 8-22206 | 1/1996 |

* cited by examiner

IMAGE FIXING APPARATUS, AND, IMAGE FORMING APPARATUS HAVING THE SAME, AND IMAGE FORMING PROCESS

BACKGROUND OF THE INVENTION

1. Field of the Invention

The present invention relates to an image fixing apparatus which can promote saving of energy in fixing and also relates to an image forming apparatus having the image fixing apparatus therein and the image forming process.

2. Description of the Related Art

There are increasingly demands on saving of energy and higher-speed processing for an image forming apparatus according to an electrophotography technique, such as, printers, copiers, facsimiles in recent years. To meet the demands, it is important to improve the thermal efficiency of an image fixing apparatus configured for fixing a toner image carried onto a recording medium by means of an image transferring process or a direct image-carrying process.

As an image fixing apparatuses for fixing a toner image, image fixing apparatuses according to a contact heating process, such as, a heat roller process, a film-heating process, and an electro magnetic induction heating process have been widely used.

An image fixing apparatus according to a heat roller process is basically configured to have a pair of rotatable rollers which comprises a fixing roller having interiorly a heat source, such as, a halogen lamp, to control the temperature to a given one, and a pressure roller brought into pressure contact with the fixing roller. In the fixing apparatus, a recording medium having a not-fixed toner image is sent into the contact portion between the pair of rotatable rollers, so-called fixing nip portion, to melt the not-fixed toner image by means of heat and pressure actions from the fixing roller and the pressure roller to fix the image.

An image fixing apparatus according to a film-heating process has been proposed in, for instance, Japanese Patent Application Laid-Open (JP-A) Nos. 63-313182, and 01-263679. These image fixing apparatuses are configured to make a recording medium having a not-fixed toner image thereon attached firmly to a heater which is mounted and supported by a supporting member through a thin fixing film having thermal resistance to feed heat from the heater to the recording medium through the fixing film while sliding and moving the fixing film to the heater. As for the heater, for example, a ceramic heater which comprises a resistive layer disposed on a ceramic substrate having properties, such as, thermal resistance, insulation, and high thermal conductivity, like an alumina and an aluminum nitride, is used. Because a thin fixing film having a low thermal capacity can be used for the fixing film, an image fixing apparatus according to a film-heating process has a higher efficiency of heat transfer and achieves a shorter warm-up time than those of an image fixing apparatus according to a heat roller process, and it enables a quick start and saving of energy.

As to an image fixing apparatus according to an electromagnetic induction heat process, for instance, there is one described in Japanese Patent Application Laid-Open (JP-A) No. 08-22206, in which a technique that the Joule heat is induced by eddy currents generated on a magnetic metal member by an alternating magnetic field to make a heater including the magnetic metal member heating through the use of electromagnetic induction is used.

Hereinafter, the image fixing apparatus disclosed in the JP-A 08-22206 will be illustrated referring to FIG. 1. An image fixing apparatus shown in FIG. 1 comprises a film inner surface guide 103 with a heater 102 mounted thereon, the heater 102 comprising an exciting coil unit 100 and an magnetic metal member 101 which is a heating section; a cylindrical film 104 having thermal resistance and wrapping around the film inner surface guide 103 in a state where the magnetic metal member 101 is held in contact with the inside wall thereof; and a pressure roller 105 which is arranged to face the magnetic metal member 101 and brought into pressure contact with the external wall of the film 104 to form a fixing nip portion N between the film 104 and itself and also rotates the film 104.

As for the film 104, a single layer having a film thickness of 100 μm or less, preferably 50 μm to 20 μm or more and thermal resistance, made from a PTFE (polytetrafluoroethylene), a PFA (perfluoroalkoxy), a FEP (fluorinated ethylene propylene) and the like, or a multilayer in which a film made from a PTFE, a PFA, and a FEP and the like coated on the outer circumference of a film made from a polyimide, a polyamideimide, a PEEK (polyether ether ketone), a PES (polyethersulfone), a PPS (polyphenylene sulfide) and the like, are used.

The film inner surface guide 103 comprises a member having rigidity and thermal resistance, formed with a PEEK resin, a PPS resin, and the like, and the heater 102 is engaged into generally the central part of the bottom surface of the film inner surface guide 103 longitudinally along the guide.

The pressure roller 105 comprises a core 105*a* and a heat-resistant rubber layer 105*b* which is coated around the core 105*a* and has excellent demolding properties, such as, a silicone rubber. The pressure roller 105 is arranged with a given pressing force so that it is brought into contact with the magnetic metal member 101 of the heater 102 through the film 104 by means of a bearing unit and a biasing unit (both not shown). The pressure roller 105 is driven to rotate in a counterclockwise direction indicated with the arrow by a drive unit (not shown).

A frictional force is generated between the pressure roller 105 and the film 104 by the rotating drive unit of the pressure roller 105 to lead the film 104 to rotate along with the pressure roller 105, and the film 104 rotates in a sliding manner with a state where it is attached firmly to the magnetic metal member 101 of the heater 102.

In the condition that the heater 102 reaches a given temperature, a recording medium P which is carrying a not-fixed toner image T formed in the image forming section (not shown) is sent to the fixing nip portion N located between the film 104 and the pressure roller 105. The recording medium P is transported to the fixing nip portion N in a state being sandwiched between the pressure roller 105 and the film, and in the course of the transport, heat from the magnetic metal member 101 is given to the recording medium P through the film 104 to lead a the not-fixed toner image T to be melted and fixed on the recording medium P. At the outlet of the fixing nip Portion N, the recording medium P passed through is separated from the surface of the film 104 to be transported to the output tray (not shown).

As described above, an image fixing apparatus according to an electromagnetic induction heating process allows the magnetic metal member 101 as an heat induction unit to be arranged close by the toner image T on the recording medium P through the film 104 by means of generation of eddy currents, and this enables a heat efficiency higher than that of an image fixing apparatus according to a film-heating process.

However, in the above noted image fixing apparatuses according to a heat roller process, a film-heating process, and an electromagnetic induction heating process, it is very difficult to take a sufficient nipping time because rollers are used in order to press a recording medium on a fixing member. To ensure a fixing within the short nipping time, the heat temperature should be set to a needlessly high temperature, which has become a subject to resolve.

Particularly in a system in which the above-noted heater 102 is used, it is impossible to take a large nip width because pressure activities are carried out using the pressure roller 105 made from a rubber, although the heater 102 having a contact surface in a shape of plane plate to be contact with the recording medium P is used. Namely, the configuration stated above makes it impossible to enlarge the nip width unless the diameter of the pressure roller is enlarged, since the rubber member is compressed and transformed by the crimping with the pressure roller 105 to press the recording medium P and the film 104 on the surface of the heater 102 to form the nip portion. Besides, there is a disadvantage that a repulsive force of the rubber portion differs at the central part of and at the end part of the contact surface with the pressure roller 105 which is made from a rubber, and a crimping force at the end part of the contact face weaker than that of the central part. With an increase in a roller diameter of the pressure roller 105, the mass of the pressure roller 105 becomes greater, and this results in a deprivation of heat needed for fixing at the time of nipping, which requires an excessively increased temperature of the heater 102. There is no way of resolving the differences in a pressure force between at the central part and at the end part of the pressure roller 105 made from a rubber, in principle. Therefore, time for undergoing a sufficient pressure force becomes shorten. To make the toner particles deformed and make the toner layer fused with and attached firmly on the surface of the recording medium P, it is required to extract fixing performance by excessively increasing the toner temperature to make the toner viscosity decreased.

It is not preferable that an excessive application of heat like this causes an increased consumption of energy in terms of energy saving since an amount of heat more than needed is needlessly given to the recording medium P and the temperature of the heater 102 becomes higher due to the increased heat temperature, which causes an increased amount of heat radiation, an increased temperature of the film 104 itself, and an increased amount of heat diffusion to the surroundings.

Further, because of raising the toner temperature in a small amount of time, the toner temperature at the portion being in contact with the film 104 extremely differs in temperature from that of the portion being in contact with the recording medium P, and the toner temperature of the portion being in contact with the recording medium P is low and becomes to have a viscosity barely enough to be fixed on the recording medium P, but the toner temperature of the portion being in contact with the film 104 has a problem that it is liable to cause an offset phenomenon because it has exceedingly high temperature and shows a sharp decrease in the viscosity of the toner.

SUMMARY OF THE INVENTION

It is an object of the present invention to provide an image fixing apparatus which enables achieving saving of energy in fixing by controlling the temperature of a heater to fix a toner image on a recording medium, and an image forming apparatus having the image fixing apparatus therein, and an image forming process using the same.

The image fixing apparatus according to the present invention comprises a heater configured to have a heat source therein to generate heat; a fixing belt configured to move in the direction of a recording medium being transported to in a state coming into contact with the heater; and a pressing portion configured for pressing the transported recording medium with a toner image carried thereon to the area of the fixing belt which comes into contact with the heater, wherein the contact surface of the heater which comes into contact with the fixing belt has a sculptured surface configured to have a smoothly formed convex toward the side which comes into contact with the fixing belt with a curvature radius of 200 mm to 100,000 mm, and the amount of contact time between the fixing belt and the recording medium is 20 msec. or more.

According to the image fixing apparatus of the present invention, the heater is heated by a heat source, heat from the heater is transmitted to the fixing belt, the transported recording medium with a toner image carried thereon is pressed to the fixing belt by the action of a pressing portion, and heat from the heater is transmitted to the recording medium through the fixing belt to thereby fix the toner image carried onto the recording medium on the recording medium. At the time of fixing, the image fixing apparatus allows firmly attaching the heater to the fixing belt to prevent an occurrence of crimples on the fixing belt, ensuring heat transfer from the heater to the fixing belt and enables preventing an occurrence of image nonuniformity caused by a crimple on the fixing belt and an occurrence of fixing nonuniformity caused by heating nonuniformity on the fixing belt. In addition, the heat quantity sent into a recording medium becomes a sufficient amount enough to be fixed even with a restrained temperature of the heater because the amount of contact time between the fixing belt and the recording medium is 20 msec. or more. Thus, it makes it possible to effectively perform a fixing while achieving saving of energy.

The image forming apparatus according to the present invention comprises a photoconductor; a latent electrostatic image forming unit configured to form a latent electrostatic image on the photoconductor; a developing unit configured to develop the latent electrostatic image using a toner to form a visible image; a transferring unit configured to transfer the visible image onto a recording medium; and a fixing unit configured to fix the transferred image on the recording medium, wherein the fixing unit is the image fixing apparatus according to the present invention.

In the image forming apparatus of the present invention, the latent electrostatic image forming unit forms a latent electrostatic image on the photoconductor, the transferring unit transfers the visible image on the recording medium, and the image fixing apparatus of the present invention makes the transferred image fixed on the recording medium, as the fixing unit. As a result, a high quality electrographic image can be formed while achieving saving of energy at the time of fixing.

The image forming process according to the present invention comprises forming a latent electrostatic image on a photoconductor; developing the latent electrostatic image using a toner to form a visible image; transferring the visible image onto a recording medium; and fixing the transferred image on the recording medium, wherein the fixing is performed using the fixing apparatus of the present invention.

In the image forming process of the present invention, a latent electrostatic image is formed on a photoconductor in the latent electrostatic image forming step, the visible image is transferred onto a recording medium in the transferring step, and the transferred image is fixed on the recording medium using the image fixing apparatus of the present invention. As a result, a high quality electrographic image can be formed while achieving saving of energy in fixing.

Figure 1:
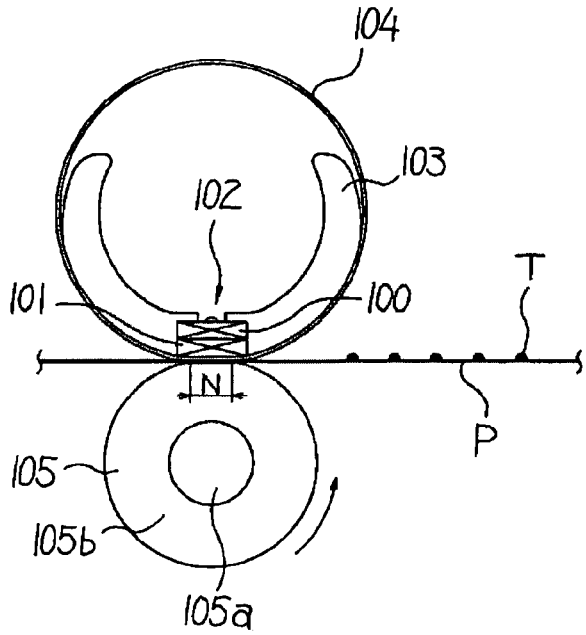
FIG. 1 is a longitudinally front view showing an illustrative example of a conventional image fixing apparatus.

DESCRIPTION OF THE PREFERRED EMBODIMENTS (Image Fixing Apparatus)

The image fixing apparatus according to the present invention comprises a heater, a fixing belt, and a pressing portion, and further comprises other members, as required.

In the image fixing apparatus, the contact surface of the heater which comes into contact with the fixing belt has a sculptured surface configured to have a smoothly formed convex toward the side which comes into contact with the fixing belt with a curvature radius of 200 mm to 100,000 mm, and the amount of contact time between the fixing belt and the recording medium is 20 msec. or more.

It is preferably the pressing portion comprises a plurality of pressure rollers which are arranged in parallel in a direction perpendicular to the direction to which a recording medium is transported. This arrangement enables pressing a recording medium on the fixing belt and advantageously achieving heat transfer from the fixing belt to the recording medium.

In addition, the pressing portion is preferably a pressing belt which moves along the direction of a recording medium being transported to. This enables pressing a recording medium on the fixing belt and advantageously achieving heat transfer from the fixing belt to the recording medium.

It is preferable that the inner surface of the pressing belt has auxiliary pressure rollers thereon which press the pressing belt to the fixing belt side. Such a configuration allows more firmly pressing a recording medium on the fixing belt and more advantageously achieving heat transfer from the fixing belt to the recording medium.

The heater is not particularly limited and may be selected in accordance with the intended use. A heater anchored in position is preferred.

The heat source of the heater is not particularly limited and may be selected in accordance with the intended use. Examples of the heat source includes a halogen lamp, a sheet heating element, a wire heater, and an exciting coil according to an electromagnetic induction heating system. By using them, heating activities of the heater can be advantageously carried out.

The contact surface of the heater preferably has a protrusion. When the contact surface of the heater has a protrusion, the moving fixing belt is pressed by the protrusion and the pressure force between the fixing belt and a recording medium has become increased instantaneously. As a result, a toner image in a molten state can be firmly imposed on the recording medium and the fixing performance can be improved.

It is preferable that both ends of the heater along the direction to which the fixing belt moves are respectively formed in a curvature radius smaller than that of the contact surface of the heater. This configuration enables preventing the fixing belt from rippling when part of the fixing belt comes into contact with the heater or when part of the fixing belt leaves the heater, and also enables preventing an occurrence of fixing nonuniformity of a toner image on a recording medium, which is caused by rippling as mentioned above.

(Image Forming Apparatus and Image Forming Process)

The image forming apparatus according to the present invention comprises a photoconductor, a latent electrostatic image forming unit, a developing unit, a transferring unit, and a fixing unit, and may further comprises the other units, for example, a charge-eliminating unit, a cleaning unit, a recycling unit, and a control unit, as required.

The fixing unit is the image fixing apparatus according to the present invention.

The image forming process according to the present invention comprises forming a latent electrostatic image, developing, transferring, and fixing, and may further comprises the others, for example, charge-eliminating, cleaning, recycling and controlling, as required.

The fixing process is performed using the image fixing apparatus according to the present invention.

The image forming process according to the present invention may be properly carried out by the image forming apparatus according to the present invention. The latent electrostatic image forming step may be performed by the latent electrostatic image forming unit, the developing step may be performed by the developing unit, the transferring step may be performed by the transferring unit, and the fixing step may be performed by the fixing unit. The others may be performed by the other unit.

—Latent Electrostatic Image Forming and Latent Electrostatic Image Forming Unit—

In the latent electrostatic image forming step, a latent electrostatic image is formed on a photoconductor.

The photoconductor is not particularly limited as to the material, shape, structure, size, and the like, and may be selected from those known in the art, but it is preferably a drum-like in shape. Examples of the material include an inorganic photoconductor, such as an amorphous silicone, and selenium; and an organic photoconductor, such as, polysilane, and phthalopolymetine. Among these materials, an amorphous silicone or the like is preferred in terms of the longer operating life.

The latent electrostatic image may be formed, for example, by charging the surface of the photoconductor, and exposing it imagewise, which may be performed by the latent electrostatic image forming unit.

The latent electrostatic image forming unit comprises, for example, a charger which uniformly charges the surface of the photoconductor, and an exposer which exposes the surface of the photoconductor imagewise.

The charging may be performed, for example, by applying a voltage to the surface of the photoconductor by means of the charger.

The charger is not particularly limited and may be selected in accordance with the intended use. Examples of the charger include a contact-type charger, known in the art, which includes a conductive or semi-conductive roll, a brush, a film, a rubber blade, or the like; and a noncontact-type charger which utilizes corona discharge, such as, corotron, and scorotron.

The exposure may be performed by exposing the surface of the photoconductor imagewise, using, for example, the exposer.

The exposer is not particularly limited and may be selected in accordance with the intended use, provided that the surface of the photoconductor charged by the charger may be exposed according to the image. Examples of the exposer include a copy optical system, a rod lens array system, a laser optical system, and a liquid crystal shutter optical system.

In the present invention, a backlight system may be employed in which the photoconductor is exposed imagewise from its rear surface.

—Developing and Developing Unit—

In the developing step, the latent electrostatic image is developed using a toner or a developer to form a visible image.

The visible image may be formed, for example, by developing the latent electrostatic image using a toner and a developer, which may be performed by means of the developing unit.

The developing unit is not particularly limited and may be selected from those known in the art, provided that it can develop an image using a toner or a developer. Examples of the developing unit include the one that houses a toner and a developer and comprises an image developer which can supply the toner and the developer with contact or without contact to the latent electrostatic image, and more preferably it further comprises a container containing a toner.

The image-developer may be of dry type or wet type, and may be a monochrome image developer or a multi-color image developer. For example, such an image-developer is preferable that comprises a stirrer that charges a toner or a developer by friction stirring, and a rotatable magnet roller.

In the image developer, for example, a toner and a carrier are mixed and stirred; the toner is thereby charged by friction and sustained in a condition of standing rice ears, and forms a magnetic brush on the surface of the rotating magnet roller. Since the magnet roller is arranged near the photoconductor, part of the toner in the magnet brush formed on the surface of the magnet roller moves to the surface of the photoconductor due to the force of electrical attraction. As a result, a latent electrostatic image can be developed by the toner, and the visible toner image is formed on the surface of the photoconductor.

—Transfer and Transferring Unit—

In the transfer, the visible image is transferred to a recording medium. In a preferred aspect, the visible image is transferred to an intermediate transfer member as a primary transfer, then the visible image is transferred on the recording member as a secondary transfer. More preferably, using a toner or two or more colors and still more preferably using a full color toner, the visible image is transferred to the intermediate transfer member to form a complex-transfer image as the primary transfer, and the complex-transfer image is transferred to the recording medium as the secondary transfer.

The transfer of the visible image may be achieved, for example, by charging the photoconductor using a transfer-charger, which may be performed by the transferring unit. In a preferred aspect, the transferring unit comprises a primary transferring unit that transfers the visible image to the intermediate transfer member to form a complex-transfer image, and a secondary transferring unit that transfers the complex-transfer image to the recording medium.

The intermediate transfer member is not particularly limited and may be selected transferring members known in the art, for instance, a transferring belt is favorable.

The transferring unit (the primary transferring unit and the secondary transferring unit) preferably comprises an image transcriber that conducts releasing charge the visible image formed on the photoconductor to the side of recording medium. The transfer unit may be one or more.

Examples of the image transcriber include a corona image transcriber according to corona discharge, a transfer belt, a transfer roller, a pressure transfer roller, and an adhesion image transcriber.

The recording medium is typically a plain paper, but is not particularly limited, provided that a polyethylene terephthalate (PET) base for overhead projector (OHP) may be employed.

In the fixing, the visible image transferred to the recording medium is fixed by means of an image fixing apparatus, which is performed using the image fixing apparatus of the present invention.

In the charge eliminating step, a discharge bias is applied to the photoconductor to conduct elimination of charge, which may be performed by means of a charge-eliminating unit.

The charge-eliminating unit is not particularly limited and may be selected from charge eliminators known in the art, provided that a discharge bias may be applied to the photoconductor; for example, a discharge lamp is preferable.

In the cleaning step, the electrographic toner remaining on the photoconductor is removed, which may be performed by means of a cleaning unit.

The cleaning unit is not particularly limited and may be selected from cleaners known in the art, provided that the electrographic toner remaining on the photoconductor can be removed. Examples of the cleaner include a magnetic brush cleaner, an electrostatic brush cleaner, a magnetic roller cleaner, a blade cleaner, a brush cleaner, a web cleaner, and the like.

In the recycling step, the electrographic color toner removed by the cleaning step is recycled to the developing unit, which may be properly performed by a recycling unit.

The recycling unit is not particularly limited and may be selected from transport units or the like known in the art.

In the control step, the individual steps or stages are controlled, which may be properly implemented by a control unit.

The control unit is not particularly limited and may be selected in accordance with the intended use, provided that the activities in the individual steps or stages can be controlled. Examples of the control unit include a device, such as, a sequencer, and a computer. Here, the image fixing apparatus according to the present invention, the image forming apparatus having the same, and the image forming process will be explained in detail referring to the accompanying drawings.

<A First Aspect>

Figure 2:
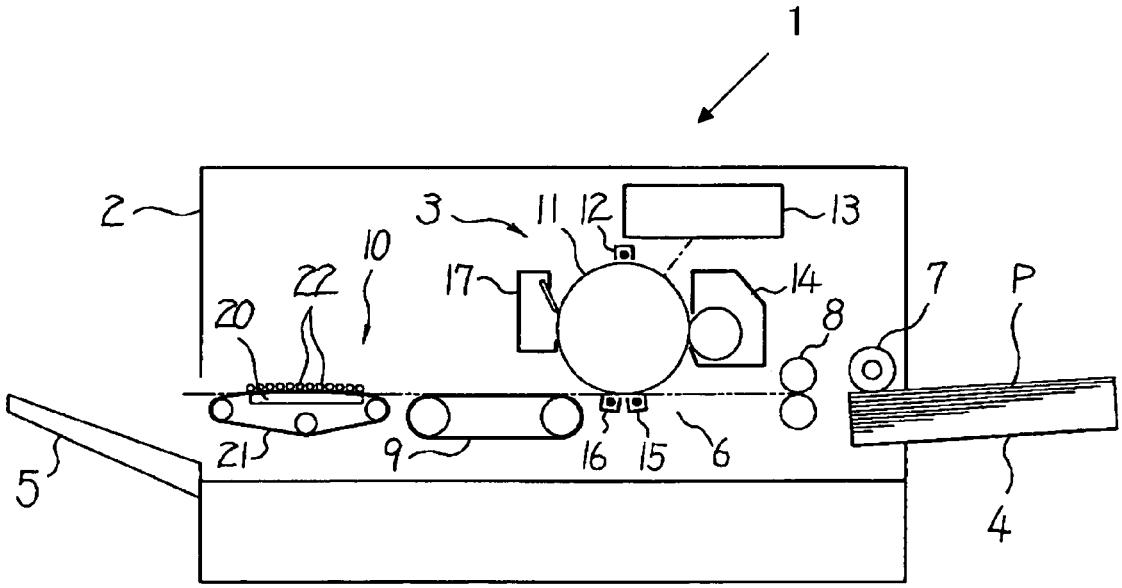
FIG. 2 is a front view schematically showing an example of the inner structure of the image forming apparatus according to a fist aspect of the present invention.

A first aspect of the present invention will be explained based on FIGS. 2 and 3. FIG. 2 is a front view schematically showing the inner structure of an image forming apparatus which is a printer 1.

This printer 1 comprises a printer engine 3 arranged in the central part of a printer body 2, on one side of the printer body 2, a sheet-feeder cassette 4 which a recording medium P will be placed thereon, attached in an attachable and detachable manner, and on the other side of the printer body 2, an output tray 5 is mounted. In the printer body 2, a transport route 6 that the recording medium P within the sheet-feeder cassette 4 is transported toward the output tray 5 is formed. On the transport route 6, a sheet feed roller 7, a resist roller 8, a printer engine 3, a transport belt 9, and an image fixing apparatus are arranged.

The printer engine 3 comprises a photoconductor drum 11 which is driven to rotate axially by a drive motor (not shown) which is supported axially in a rotatable fashion, a charger 12 which is located around the photoconductor 11, an optical writing unit 13, an image developing unit 14, an electrode for transfer 15, an electrode for separation 16, a cleaning unit 17, and the like. The charger 12 is supplied with a negative high-voltage current from a high-voltage power supply (not shown) to charge the circumferential surface of the photoconductor 11 uniformly. The optical writing unit 13 comprises a laser beam source and a polygon mirror and outputs laser beam according to the image data input from an external device, such as, a personal computer to form a latent electrostatic image according to the image data on the circumferential surface of the photoconductor 11 by exposing the circumferential surface of the photoconductor 11 using the laser beam. The image developing unit 14 develops the latent electrostatic image as a toner image by supplying a toner to the photoconductor 11. The electrode for transfer 15 is supplied with a positive high-voltage current from the high-voltage power supply to transfer the toner image on the photoconductor 11 to a recording medium P. The electrode for separation 16 is supplied with an alternating high-voltage current from the high-voltage power supply and conducts charge eliminating of the recording medium P to make the recording medium P separated from the photoconductor 11. The cleaning unit 17 performs cleaning of toner remaining on the photoconductor 11.

With the above configuration of the printer 1, when an image data is input from an external device, such as, a personal computer, the printer engine 3 starts forming an image in accordance with the image data. In the image forming by the printer engine 3, laser beam is output from the optical writing unit 13 depending on the input image data, and the surface of the photoconductor 11 is exposed and scanned by the output laser beam. A latent electrostatic image is formed on the surface of the photoconductor by the exposure and scanning, and then the latent electrostatic image is developed by a toner supplied from the image developing unit 14 to form a toner image.

At the time of the image forming activities by the printer engine 3, then, almost in tandem, the transport of a recording medium P is started from within the sheet-feeder cassette 4, and the recording medium P is transported through the transport route 6. The recording medium P transported through the transport route 6 is sent to a transport position between the photoconductor 11 and the electrode for transfer 15 in timing with the image forming activities in the printer engine 3 and then the toner image on the photoconductor 11 is transferred to the recording medium P. The recording medium P with the toner image transferred thereon is separated from the photoconductor 11 by the action of the electrode for separation 16. After the separation, the recording medium P is transported to the image fixing apparatus 10 through the transport belt 9, the recording medium P is then subjected to a fixing process in which application of heat and pressure to the recording medium P is performed using the image fixing apparatus, and the recording medium P subjected to the fixing process is ejected to the output tray 5.

Characteristic portions of the first aspect of the present invention with the above-noted configuration will be described in series. The image fixing apparatus of the present invention 10 comprises a heater 20, an endless fixing belt 21, and a plurality of pressure rollers 22 individually having a small diameter, which constitutes the pressure portion.

The heater is a member having a heat source to generate heat, the heater is heated by the heat source, and heat from the heater 20 is transmitted to the fixing belt 21. For the heat source, a halogen lamp, a sheet heating element, a wire heater, and an exciting coil according to an electromagnetic induction heating system are available. In the image fixing apparatus of the present invention, any of these heating units may be used, but an electromagnetic induction heating system excels in heat responsiveness to the fixing belt 21, because the portion of the heat source nearest to the fixing belt 21 generates heat. A halogen lamp and a sheet heating element are controlled by power-on or power-off of power distribution, and a wire heater is controlled by pulse of power distribution. The length of the heater 20 along the direction of the recording medium P being transported is set, for example, to 10 mm. The transport speed is set, for example, to 20 mm/sec. or more.

Figure 4:
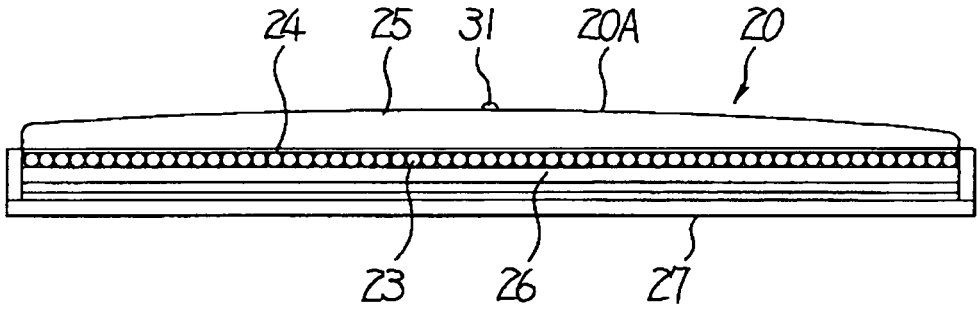
FIG. 4 is a sectional view showing an example of the structure of the heater in the image fixing apparatus according to the present invention.

FIG. 4 is a sectional view showing the structure of a heater in which an exciting coil 23 is used as the heat source. The heater 20 has the exciting coil 23 which generates a magnetic field, and a coil guide plate 24 with the exciting coil 23 winded up around. The coil guide plate 24 is arranged in close vicinity to the outer circumference of a magnetic metal 25. The exciting coil 23 is the one that a long exciting coil wire rod is alternately winded up along the coil guide plate 24 in the axial direction of the magnetic metal 25. In addition, the exciting coil 23 is connected to a drive power source (not shown) of which the oscillation circuit is variable-frequency.

At the outer side of the exciting coil 23, an exciting coil core 26 made from a ferromagnetic material, such as, a ferrite, is arranged in close vicinity to the exciting coil 23 and fixed by a supporting member of the exciting coil core 27. In the first aspect of the present invention, an exciting coil core having a relative magnetic permeability of 2,500 is used for the exciting coil core 26.

A high-frequency alternating current of 10 kHz to 1 MHz, preferably a high-frequency alternating current of 20 kHz to 800 kHz is supplied to the exciting coil 23 from the drive power source, and an alternating field is thereby generated. The alternating magnetic field works on the magnetic metal 25 in the area which the magnetic metal 25 comes into contact with the fixing belt 21, and at the inner side of the magnetic metal 25, an eddy current flows in the direction that a change in the magnetic filed is prevented. The eddy current generates Joule heat in response to and in accordance with the resistance of the magnetic metal 25, and then the magnetic metal 25 is heated by electromagnetic induction.

Then, heat held in the magnetic metal is transmitted to the fixing belt 21. Part of the circumferential surface of the magnetic metal 25 is defined as a contact surface 20A of the heater 20 which comes into contact with the fixing belt 21.

The fixing belt 21 is spanned over the heater 20, a driving roller 28, a guide roller 29, and a tension roller 30, and the driving force from the driving roller 28 moves the fixing belt 21 as indicated with the arrows. Here, the direction of movement of the fixing belt 21's area coming into contact with the contact surface 20A of the heater 20 faces in the same direction of the recording medium P being transported.

The fixing belt 21 is defined to have a thickness of 1 μm to 400 μm. However, when the fixing belt becomes thinner, its durability becomes decreased by just that much, and when it becomes thicker, the thermal capacity becomes increased and it takes a longer time for the risetime. Therefore, for the fixing belt 20, it is preferably to have a thickness of 5 μm to 300 μm, more preferably a thickness of 10 μm to 200 μm, and still more preferably a thickness of 30 μm to 150 μm.

The fixing belt 21 is not particularly limited, provided that it has thermal resistance, and, for instance, a single layer made from a PTFE, a PFA, a FEP and the like, or a multilayer in which a film made from a PTFE, a PFA, and a FEP and the like coated on the outer circumference of a film made from a polyimide, a polyamideimide, a PEEK, a PES, a PPS and the like may be used for the fixing belt 21.

The pressure rollers 22 are arranged in parallel in a direction perpendicular to the direction of a recording medium being transported to, and are axially held in a rotatable fashion. These pressure rollers 22 are pressed by the contact surface 20A of the heater 20 through the fixing belt 21 and are led to rotate along with the rotation of the fixing belt 21 which is driven to move by the driving roller 28. The transported recording medium P with the toner image T carried thereon is sent to the portion between the fixing belt 21's area coming into contact with the contact surface 20A of the heater 20 and the pressure rollers 22.

In the aspect of the present invention, the configuration of the contact surface 20A of the heater 20 which comes into contact with the fixing belt 21 is defined that each part of the contact surface 20A has a sculptured surface configured to have a smoothly formed convex toward the side which comes into contact with the fixing belt with a curvature radius of 200 mm to 100,000 mm. The entire contact surface 20A does not necessarily have a uniformly formed curvature, and the each part of the contact surface 20A may have a smoothly formed curvature radius of 200 mm to 100,000 mm. By defining the configuration of the contact surface 20A as described above, the contact surface 20A of the heater 20 becomes firmly attached to the fixing belt 21, and it makes possible to prevent an occurrence of crimples on the fixing belt 21 and assured heat transmission to the fixing belt 21. Further, it also makes it possible to prevent an occurrence of image nonuniformity in the recording medium P caused by a crimple on the fixing belt 21 and an occurrence of fixing nonuniformity due to heating nonuniformity on the fixing belt 21. In other words, when the contact surface 20A of the heater 20 is formed in a plane surface, tensile crimples are liable to occur on the fixing belt 21 due to tension brought from the fixing belt 21, but the configuration of the contact surface 21A of the first aspect enables preventing such a problem. In addition, when the contact surface 20*a* of the heater 20 is formed in a concave, the fixing belt 21 gets floating and becomes difficult to be firmly attached to the contact surface 20A, but the configuration of the contact surface 21A of the first aspect enables preventing such a problem.

On the other hand, if the curvature radius of the contact surface 20A of the heater 20 is smaller than 200 mm, slip is liable to occur between the fixing belt 21 and the recording medium P, and a difference in speed between the circumferential speed of the fixing belt 21 and that of the recording medium P occurs to cause image nonuniformity. Thus, it is desired that the contact surface 20A has a curvature radius of 200 mm to 100,000 mm, preferably 300 mm or more, further more preferably 400 mm or more, and still more preferably 500 mm or more. However, when this curvature radius is set in an exceedingly large size, tensile crimples are liable to occur on the fixing belt 21, and the fixing belt 21 is liable to get floating from the contact surface 20A. Therefore, the upper limit of the curvature radius of the contact surface 20A is preferably limited to 50,000 mm or less, and more preferably to 10,000 mm or less.

In addition, both ends of the heater 20 along the direction of the fixing belt 21 moving to is formed to have a curvature radius smaller than that of the contact surface 20A. This configuration makes the contact surface 20A and the fixing belt 21 quickly come into contact one another or quickly separate from each other when the fixing belt 21 is driven to move by the driving roller 28 to come into contact with the contact surface 20A or when the fixing belt 21 is separating from the contact surface 20A, and enables preventing an occurrence of a rippling phenomenon on the fixing belt 21. Consequently, it is possible to prevent contact nonuniformity between the recording medium P and the fixing belt 21 caused by such a rippling phenomenon and an occurrence of fixing nonuniformity of the toner image T on the recording medium P.

A protrusion 31 is formed on the contact surface 20A of the heater 20. The protrusion 31 is formed in a straight line along a longitudinal direction of the contact surface 20A (in the direction perpendicular to the direction which the fixing belt moves to). Since the portion of the fixing belt 21, which moves in contact with the contact surface 20A, coming into contact with the protrusion 31 is instantaneously pushed up in a direction pressed by the recording medium P and the pressure force between the recording medium P and the fixing belt 21 is instantaneously increased, it is possible to firmly impose the toner image T in a molten state on the recording medium P and to achieve improvements in its fixing performance. The position to form the protrusion 31 may reside in any portions in the contact surface 20A, but a portion which has undergone a molten state of the toner image T carried on the recording medium P is desired, and specifically, it is desired to be positioned on the downstream side from the mid stream area along the direction to which the recording medium P is transported.

In this aspect, the amount of contact time between the fixing belt 21 and the recording medium P is set to 20 msec. or more. By heating the recording medium P in a state where it comes into contact with the fixing belt 21 for 20 msec. or more, the temperature of the contact surface 20A of the heater 20 can be 10° C. or more decreased when fixing the toner image T on the recording medium P, compared to that of the heating section of a conventional image fixing apparatus. Namely, in this aspect, it becomes possible to supply a sufficient heat quantity to the recording medium P and the toner image T even with a lowered temperature of the contact surface 20A, because of a longer time for spending for nipping.

The amount of contact time between the fixing belt 21 and the recording medium P may be 20 msec. or more, preferably 30 msec., further preferably 50 m sec. or more, and still more preferably 100 msec. or more. However, as a result of studies, with 10 sec. or more application of heat, it was impossible to obtain the effect more than the above stated. To heat such a large amount of time requires a large-sized heater, and the surface area of the heater excessively becomes large, and so this has an opposite effect of making the amount of heat radiation larger. It is not preferable that it needlessly takes long time to raise the temperature of an oversized heater. The studies show that the amount of time for application of heat that can show an effective result based on a longer time heating is 5 sec. or less. In consideration of the heat radiation and temperature rising speed, it is preferably 2 sec. or less, and more preferably 1 sec. or less.

<Second Aspect>

Figure 5:
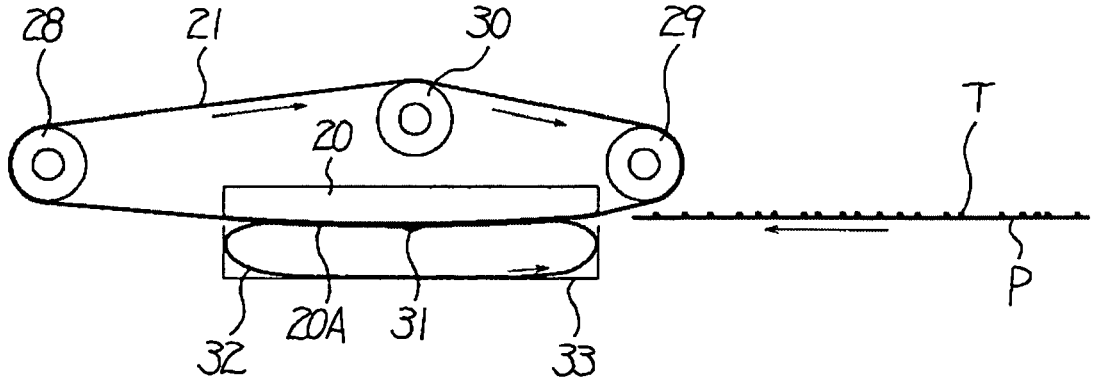
FIG. 5 an expanded front view showing an example of the image fixing apparatus according to a second aspect of the present invention.

A second aspect of the present invention will be illustrated referring to FIG. 5. It is noted that the parts same as the ones explained in FIG. 2 to FIG. 4 are indicated with identical numbers and the explanation thereof are omitted. (Same applies to the subsequent aspects).

The second aspect of the present invention is an image fixing apparatus in which a pressing belt 32 is substituted for a plurality of pressure rollers 22 provided as the pressing portion, and used as the pressing portion. The other configurations are same as the first aspect of the present invention except that the heater is mounted in a state of turned upside down.

The pressing belt 32 is formed with a film having an elastic repulsive force and housed within a case 33. In the case 33, the area on the fixing belt 21 which faces the contact surface 20A of the heater 20 opens, and the film housed within the case 33 is pressed to the area on the fixing belt 21 which comes into contact with the contact surface 20A of the heater 20 by its own elasticity. The pressing belt 32 is led to rotate along with the rotation of the fixing belt 21 which is driven to move by the driving roller 28. The recording medium P with the toner image T carried thereon is sent through the portion where the fixing belt 21 and the pressing belt 32 are pressed each other.

In the second aspect of the present invention, the amount of contact time between the fixing belt 21 and the recording medium P is defined as 20 msec. or more, same as the first aspect of the present invention. Also, in this aspect, the configuration of the contact surface 20A of the heater 20 is defined that each part of the contact surface 20A has a sculptured surface configured to have a smoothly formed convex toward the side which comes into contact with the fixing belt with a curvature radius of 200 mm to 100,000 mm.

Accordingly, in the second aspect, it is also possible to properly carry out fixing even with a lowered temperature of the heater 20 and to effectively perform fixing while achieving saving of energy, just as in the first aspect of the present invention.

Figure 6:
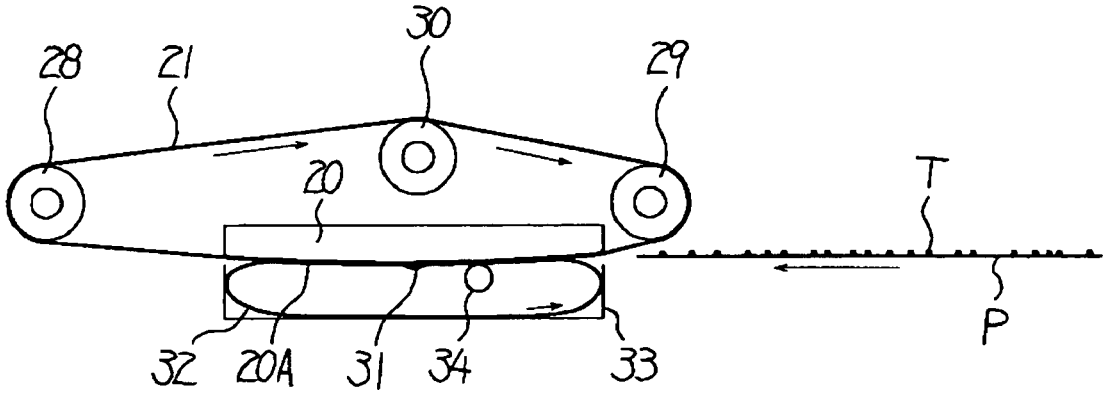
FIG. 6 is a front view showing a transformed example of the image fixing apparatus in FIG. 5.

As shown in FIG. 6, on the inner circumferential surface of the pressing belt 32, an auxiliary pressure roller 34 may be mounted, which presses the pressing belt 32 on the fixing belt 21 side. By attaching the auxiliary pressure roller 34, it makes possible to increase the contact pressure between the recording medium P and the fixing belt 21 and to increase the fixing efficiency. FIG. 6 illustrates a case of mounting one auxiliary pressure roller on the inner circumferential surface of the pressing belt 32, but a plurality of auxiliary pressure rollers like the auxiliary pressure roller 34 may be arranged in parallel thereon.

<Third Aspect>

Next, a third aspect of the present invention will be explained referring to FIG. 7. In the third aspect, a pressing belt 35 is substituted for the pressure rollers 22 and the pressing belt 32 provided as the pressing portion, and is used as the pressing portion. The other configurations are same as the second aspect of the present invention.

A pressing belt 35 is spanned over a driving roller 36, a guide roller 37, and a tension roller 38, and moves in the direction indicated with an arrow by the driving force from the driving roller 36. At that time, the pressing belt 35 is pressed on the area which comes into contact with the contact surface 20A of the heater 20.

The recording medium P with the toner image T carried thereon is sent through the portion where the fixing belt 21 and the pressing belt 35 are pressed each other. The fixing belt 21 moves in the direction indicated with the arrows by the driving force from the driving roller 28, and the pressing belt 35 moves in the direction indicated with the arrow by the driving force from the driving roller 36.

In the third aspect of the present invention, the amount of contact time between the fixing belt 21 and the recording medium P is defined as 20 msec. or more, same as the first and second aspects of the present invention. Also, in this aspect, the configuration of the contact surface 20A of the heater 20 is defined that each part of the contact surface 20A has a sculptured surface configured to have a smoothly formed convex toward the side which comes into contact with the fixing belt with a curvature radius of 200 mm to 100,000 mm.

Accordingly, in the third aspect, it is also possible to properly carry out fixing even with a lowered temperature of the heater 20 and to effectively perform fixing while achieving saving of energy, just as in the first and second aspects of the present invention.

Figure 8:
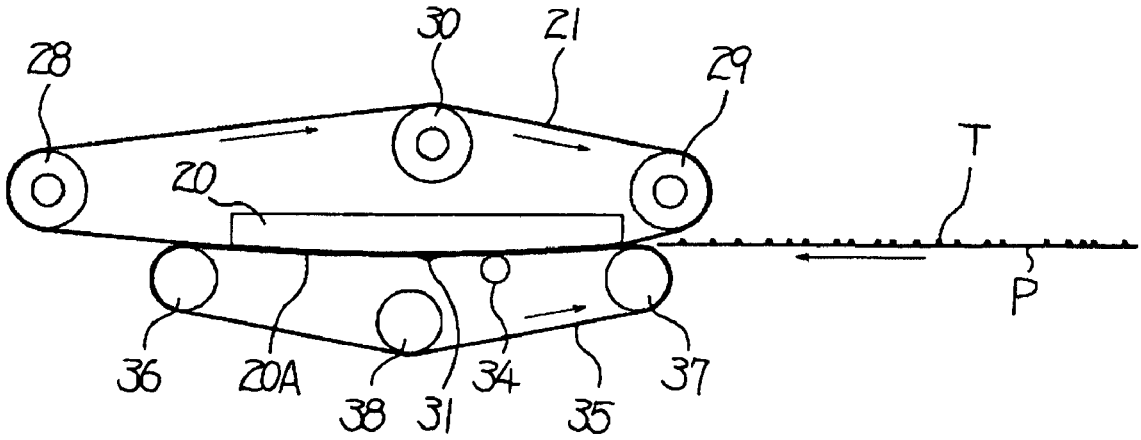
FIG. 8 is a front view showing a transformed example of the image fixing apparatus in FIG. 7.

As shown in FIG. 8, on the inner circumferential surface of the pressing belt 35, the auxiliary pressure roller 34 may be attached, which presses the pressing belt 35 on the fixing belt 21 side. By attaching the auxiliary pressure roller 34, it makes possible to increase the contact pressure between the recording medium P and the fixing belt 21 and to increase the fixing efficiency. FIG. 8 illustrates a case of mounting one auxiliary pressure roller on the inner circumferential surface of the pressing belt 32, but a plurality of auxiliary pressure rollers like the auxiliary pressure roller 34 may be arranged in parallel thereon.

Hereafter, specific examples of the present invention will be described referring to the accompanying drawings; however, the present invention is not limited to the disclosed examples. On the contrary, the present invention is intended to cover various modifications and equivalent arrangements included within the spirit and scope of the appended claims.

EXAMPLE 1

Figure 3:
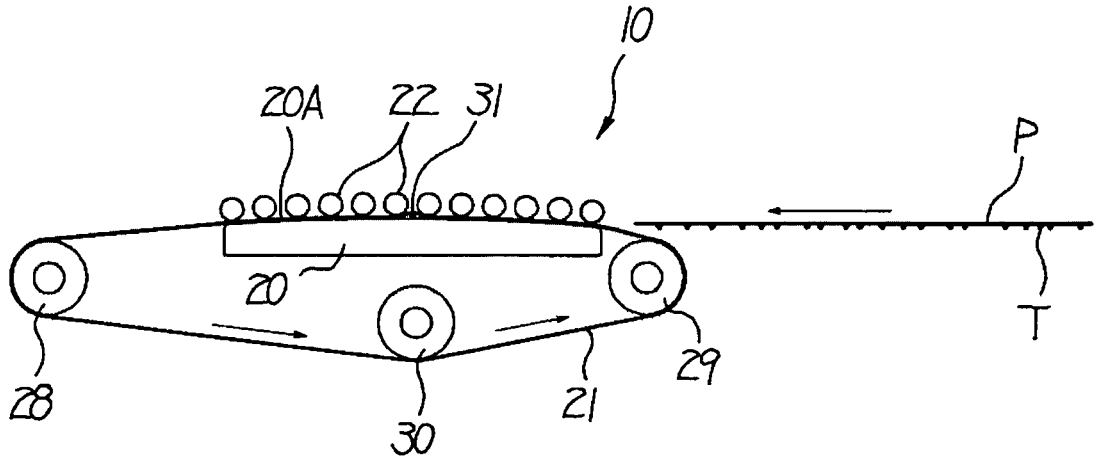
FIG. 3 is an expanded front view showing an image fixing apparatus in the image forming apparatus in FIG. 2.

In Example 1, using an image fixing apparatus shown in FIG. 3, the recording medium P was made in contact with the fixing belt 21 for a contact time of 50 msec., and the contact surface 20A of the heater 20 which comes into contact with the fixing belt was configured to have a convex facing the side coming into contact with the fixing belt with a curvature radius of 1,000 mm and conducted a fixing test. As a result, it was possible to decrease the fixing temperature 10° C. lower than that of a conventional image fixing apparatus according to a heat roller technique, and the quality of image also became improved. It was also possible to achieve the risetime of 9 sec. in reaching a specified temperature from the temperature when the apparatus cooled down.

In Example 1, a halogen lamp was used for the heat source of the heater 20, and the curvature radius at both ends of the heater 20 along the direction of the movement of the fixing belt 21 was set to be smaller than that of the contact surface 20A.

EXAMPLE 2

In Example 2, using an image fixing apparatus shown in FIG. 5, the recording medium P was made in contact with the fixing belt 21 for a contact time of 100 msec., and the contact surface 20A of the heater 20 which comes into contact with the fixing belt was configured to have a convex facing the side coming into contact with the fixing belt with a curvature radius of 1,000 mm and conducted a fixing test. As a result, it was possible to decrease the fixing temperature 15° C. lower than that of a conventional image fixing apparatus according to a heat roller technique, and the quality of image also became improved. It was also possible to achieve the risetime of 6 sec. in reaching a specified temperature from the temperature when the apparatus cooled down. In Example 2, a sheet heat element was used for the heat source of the heater 20, and the curvature radius at both ends of the heater 20 along the direction of the movement of the fixing belt 21 was set to be smaller than that of the contact surface 20A.

EXAMPLE 3

Figure 7:
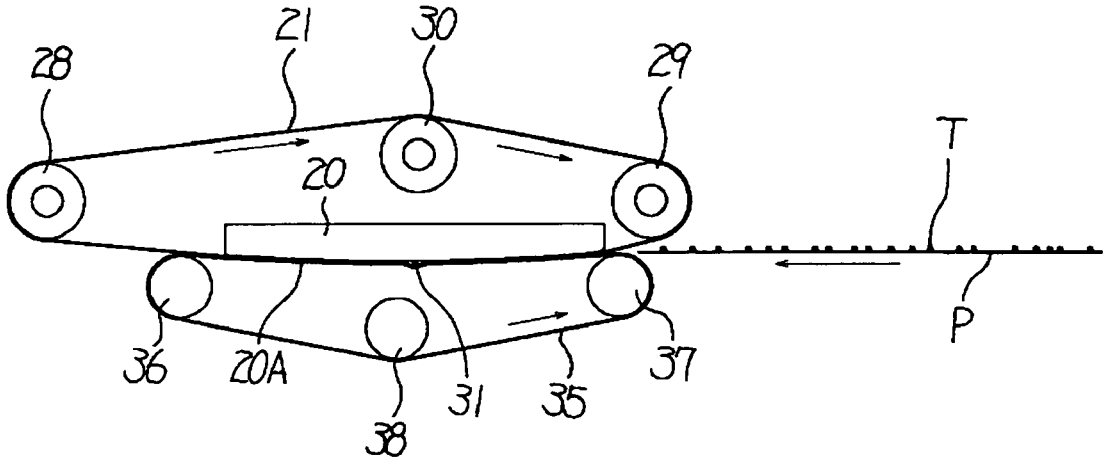
FIG. 7 is an expanded front view showing an example of the image fixing apparatus according to a third aspect of the present invention.

In Example 3, using an image fixing apparatus shown in FIG. 7, the recording medium P was made in contact with the fixing belt 21 for a contact time of 100 msec., and the contact surface 20A of the heater 20 which comes into contact with the fixing belt was configured to have a convex facing the side coming into contact with the fixing belt with a curvature radius of 1,000 mm and conducted a fixing test. As a result, it was possible to decrease the fixing temperature 15° C. lower than that of a conventional image fixing apparatus according to a heat roller technique, and the quality of image also became improved. It was also possible to achieve the risetime of 6 sec. in reaching a specified temperature from the temperature when the apparatus cooled down. In Example 3, a wire heater was used for the heat source of the heater 20, and the curvature radius at both ends of the heater 20 along the direction of the movement of the fixing belt 21 was set to be smaller than that of the contact surface 20A.

EXAMPLE 4

In Example 4, using an image fixing apparatus shown in FIG. 8, the recording medium P was made in contact with the fixing belt 21 for a contact time of 100 msec., and the contact surface 20A of the heater 20 which comes into contact with the fixing belt was configured to have a convex facing the side coming into contact with the fixing belt with a curvature radius of 1,000 mm and conducted a fixing test. As a result, it was possible to decrease the fixing temperature 15° C. lower than that of a conventional image fixing apparatus according to a heat roller technique, and the quality of image also became improved. It was still further possible to decrease the fixing temperature 10° C. lower than that of a conventional image fixing apparatus according to an electromagnetic induction technique. In Example 4, the exciting coil 23 was used for the heat source of the heater 20, and the curvature radius at both ends of the heater 20 along the direction of the movement of the fixing belt 21 was set to be smaller than that of the contact surface 20A.

EXAMPLE 5

In Comparative Example 1, an image fixing apparatus shown in FIG. 8 in the same configurations as Example 4 is used, except that there was no curvature radius smaller than that of the contact surface 20A formed at both ends of the heater 20 along the direction of the movement of the fixing belt 21. As a result, the recording medium P after the fixing, moiré patterns in vertical waves were observed on a halftone image.

What is claimed is:

1. An image fixing apparatus comprising:

a heater having a heat source to generate heat, a fixing belt configured to be moved in a direction to which a recording medium is transported in a state of coming into contact with the heater, and a pressing portion configured to press the transported recording medium with a toner image carried thereon on an area of the fixing belt which comes into contact with the heater, wherein the contact surface of the heater which comes into contact with the fixing belt has a smoothly formed convex toward the side which comes into contact with the fixing belt with a curvature radius of 200 mm to 100,000 mm, and wherein an amount of contact time between the fixing belt and the recording medium is 20 msec. or more.

2. The image fixing apparatus according to claim 1, wherein the pressing portion comprises a plurality of pressure rollers arranged in parallel in a direction perpendicular to the direction to which a recording medium is transported.

3. The image fixing apparatus according to claim 1, wherein the pressing portion is a pressing belt which moves along the direction to which a recording medium is transported.

4. The image fixing apparatus according to claim 3, wherein the inner circumferential surface of the pressing belt has an auxiliary pressure roller which presses the pressing belt on the fixing belt side.

5. The image fixing apparatus according to claim 1, wherein the heat source of the heater is a halogen lamp.

6. The image fixing apparatus according to claim 1, wherein the heat source of the heater is a sheet heating element.

7. The image fixing apparatus according to claim 1, wherein the heat source of the heater is a wire heater.

8. The image fixing apparatus according to claim 1, wherein the heat source of the heater is an exciting coil according to an electromagnetic induction technique.

9. The image fixing apparatus according to claim 1, wherein the contact surface of the heater which comes into contact with the fixing belt has a protrusion.

10. The image fixing apparatus according to claim 1, wherein the fixing belt has a thickness of 1 μm to 400 μm.

11. The image fixing apparatus according to claim 1, wherein both ends of the heater along a direction to which the fixing belt moves are respectively formed in a curvature radius smaller than that of the contact surface of the heater.

12. An image forming apparatus comprising:

a photoconductor, a latent electrostatic image forming unit configured to form a latent electrostatic image on the photoconductor, a developing unit configured to develop the latent electrostatic image using a toner to form a visible image, a transferring unit configured to transfer the visible image onto a recording medium, and a fixing unit configured to fix the transferred image on the recording medium, wherein the fixing unit comprises a heater having a heat source to generate heat, a fixing belt configured to be moved in a direction to which a recording medium is transported in a state of coming into contact with the heater, and a pressing portion configured to press the transported recording medium with a toner image carried thereon on an area of the fixing belt which comes into contact with the heater, wherein the contact surface of the heater which comes into contact with the fixing belt has a smoothly formed convex toward the side which comes into contact with the fixing belt with a curvature radius of 200 mm to 100,000 mm, and wherein an amount of contact time between the fixing belt and the recording medium is 20 msec. or more.

13. An image forming process comprising forming a latent electrostatic image on a photoconductor, developing the latent electrostatic image using a toner to form a visible image, transferring the visible image on a recording medium, and fixing the transferred image on the recording medium, wherein the fixing is performed using an image fixing apparatus which comprises a heater having a heat source to generate heat, a fixing belt configured to be moved in a direction to which a recording medium is transported in a state of coming into contact with the heater, and a pressing portion configured to press the transported recording medium with a toner image carried thereon on an area of the fixing belt which comes into contact with the heater, wherein the contact surface of the heater which comes into contact with the fixing belt has a smoothly formed convex toward the side which comes into contact with the fixing belt with a curvature radius of 200 mm to 100,000 mm, and wherein an amount of contact time between the fixing belt and the recording medium is 20 msec. or more.

* * * * *